United States Patent [19]

Carter

[11] Patent Number: 4,891,005

[45] Date of Patent: Jan. 2, 1990

[54] PORTABLE IGNITER FOR FIREPLACE LOGS

[76] Inventor: Ralph E. Carter, 2242 Old Mill Road, Carrollton, Tex. 75007

[21] Appl. No.: 235,379

[22] Filed: Aug. 23, 1988

[51] Int. Cl.[4] ..... F23D 11/36

[52] U.S. Cl. ..... 431/343; 431/344; 431/345; 126/512; 126/25 B

[58] Field of Search ..... 126/25 B, 512; 431/343, 431/344, 345; 239/566

[56] References Cited

U.S. PATENT DOCUMENTS

| | | | |
|---|---|---|---|
| 1,012,355 | 12/1911 | Herder | 431/345 X |
| 2,319,721 | 5/1943 | Coker | 126/512 X |
| 3,042,109 | 7/1962 | Peterson | 126/512 |
| 4,522,585 | 6/1985 | Martin | 126/25 B X |
| 4,779,608 | 10/1988 | Smith | 126/25 B X |

*Primary Examiner*—Randall L. Green
*Attorney, Agent, or Firm*—Dennis T. Griggs

[57] ABSTRACT

A portable igniter for igniting logs on a fireplace grate to a flame burning state. The igniter is comprised of a tubular burner having fuel emitting ports adapted to be supported for placement beneath a grate on which the burner is connected via a separable coupling and flexible hose to a gas regulating valve mounted on a cylinder tank charged with propane gas. The burner portion of the apparatus is adapted to remain in place within the fireplace beneath the grate until a self-sustaining blaze is produced. The connector hose, regulator valve and a propane cylinder are normally detached after ignition of a log is completed and are thereafter stored conveniently in and about the household for future use.

1 Claim, 2 Drawing Sheets

PORTABLE IGNITER FOR FIREPLACE LOGS

FIELD OF THE INVENTION

This invention relates generally to fireplace accessories, and in particular to a portable log igniter which uses a replaceable cannister of pressurized gas for fuel.

BACKGROUND OF THE INVENTION

Few enjoyments in life are more serene and tranquilizing than watching an open fire in a fireplace. Yet, igniting the logs to initiate a continuous low level sustaining flame sometimes involves a prolonged effort that can ultimately be regarded as too difficult or troublesome. Because of the problems associated with ignition, having a log fire is more often than not considered unworthy of the effort. This is particularly so where the logs are of an unseasoned hardwood, such as oak, that is relatively difficult to ignite. A burning bundle of newspaper is probably the most common and only sometimes effective log igniter in current use. Consequently, there are many residences and/or commercial installations in which the fireplace is unused because of the trouble and difficulties associated with the building of a log fire.

BACKGROUND OF THE PRIOR ART

Various forms of log igniters are known aside from a burning bundle of newspaper. A combustible fluid may be applied. One type of commercial igniter has an electrically energized coil that is pressed against the log. While such units are useful, they are usually only locally effective and even then require an undue length of time before a self-sustaining flame is produced.

In those parts of the country where homes are heated with gaseous fuels, such as natural gas, it has been a common practice to install a burner pipe in the fireplace beneath the grate. The burner is permanently connected through a shut off valve to a gas source. Building a log fire with such a burner is relatively simple and most effective by merely igniting the burner and permitting gas to burn until the logs are completely ignited. However, many homes are not heated with gaseous fuel, and even among those that are, many are not equipped with a permanent burner installation in the fireplace.

OBJECTS OF THE INVENTION

The principal object of the invention is to provide an improved, portable igniter for starting a fire in a fireplace.

A related object of the invention is to provide an improved log igniter for safely igniting logs in a fireplace in a relatively short time period with a minimum of effort.

Another object of the invention is to provide a portable log igniter which uses a replaceable source of gaseous fuel which is comparable in level of effort and performance with permanent plumbing gas installations provided for that purpose.

SUMMARY OF THE INVENTION

This invention relates to a log igniter for igniting fireplace logs. More specifically, the invention relates to a log igniter which is portable and divided into separate internal and external sections that can be easily and quickly assembled at the hearth for supplying a gaseous fuel to a burner supported beneath a fireplace grate. After satisfactory ignition is completed, the igniter can be disassembled and placed in storage for use at a later time.

The foregoing is achieved in accordance herewith by means of a portable igniter having an external fuel delivery section and an internal burner section in the form of a tubular burner of cast iron pipe in which gas ports have been provided at selected spacings. The fuel delivery section includes an elongated length of metal pipe terminating in a quick connector plug and a flexible hose. The flexible hose section has a coupling for quick connect/disconnect to the connector plug of the internal section, and is connected at its opposite end through a regulating valve to a pressurized cylinder of bottled gas. The internal burner section is supported on the hearth beneath the grate within the fireplace while the rigid delivery pipe and coupling section extends outside of the fireplace and is supported on the fireplace platform. According to this arrangement, the flexible delivery hose and pressurized gas cylinder are positioned safely away from the gas flame.

The foregoing features and advantages of the invention as well as other superior aspects thereof will be appreciated by those skilled in the art upon reading the detailed description which follows in conjunction with the drawings.

DESCRIPTION OF THE PREFERRED EMBODIMENT

Figure 1:
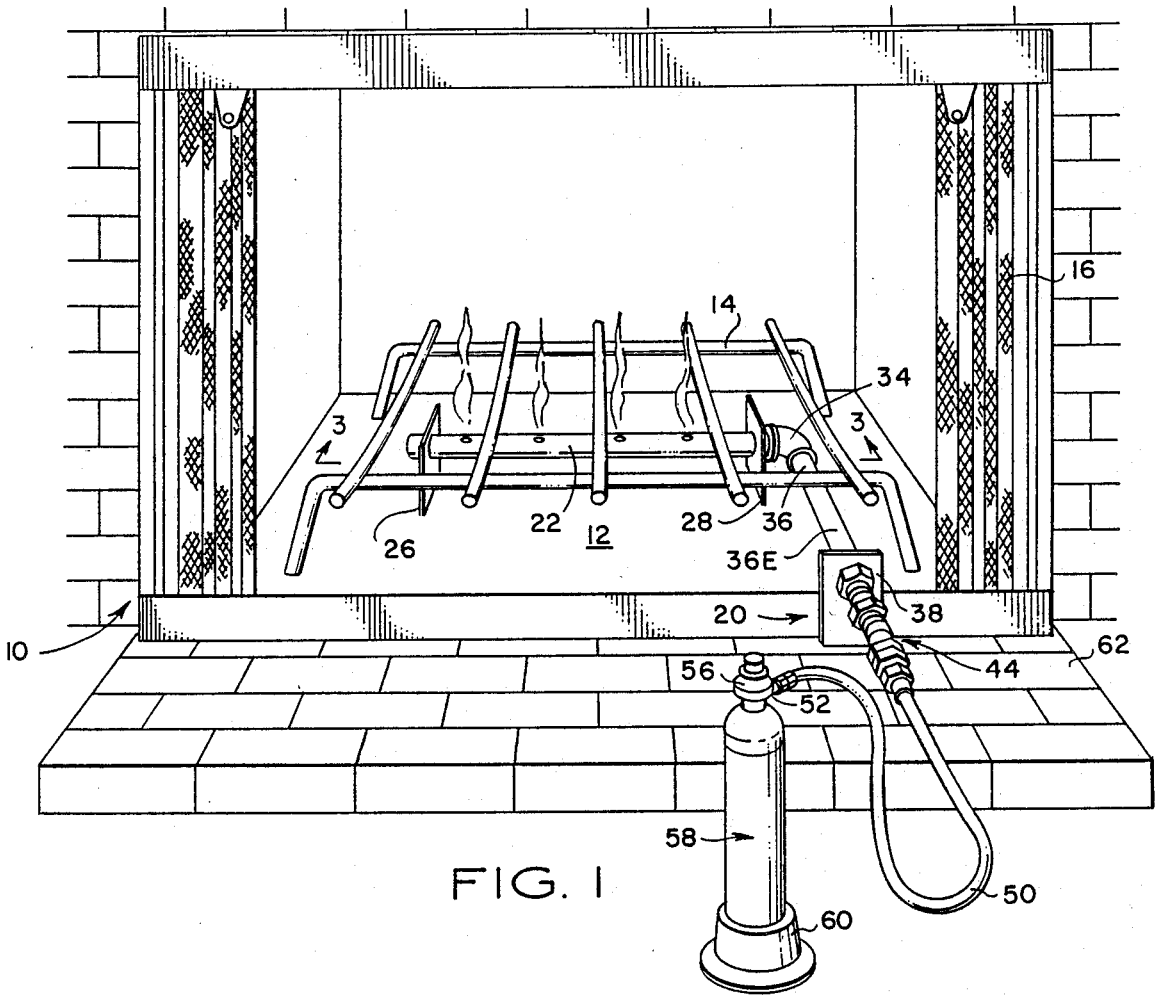
FIG. 1 is a front perspective elevation illustrating a fireplace with which the apparatus of the invention hereof is being utilized.

In the description which follows, like parts are marked throughout the specification and drawings with the same reference numerals, respectively. The drawing figures are not necessarily to scale and the proportions of certain parts have been exaggerated for purposes of clarity.

Referring now to the drawings, there is illustrated in FIG. 1 a fireplace designated 10 having a hearth 12 on which is supported an upstanding log grate 14. A screen 16 is provided that can be drawn across the fireplace opening to prevent ember sparks from being projected outward into the room space. A log 18 to be ignited is shown in phantom in FIG. 3.

Figure 3:
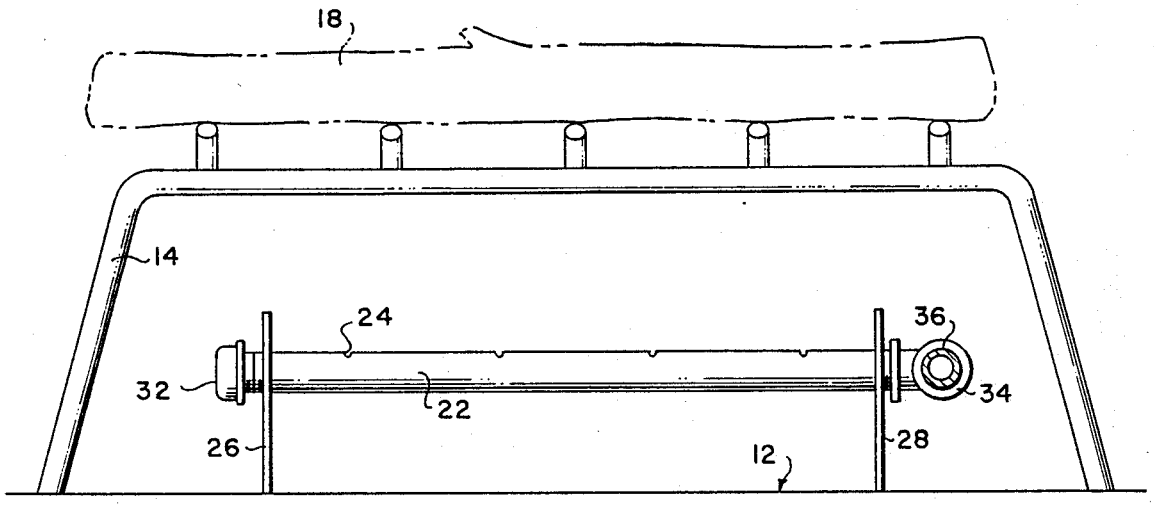
Figure 2:
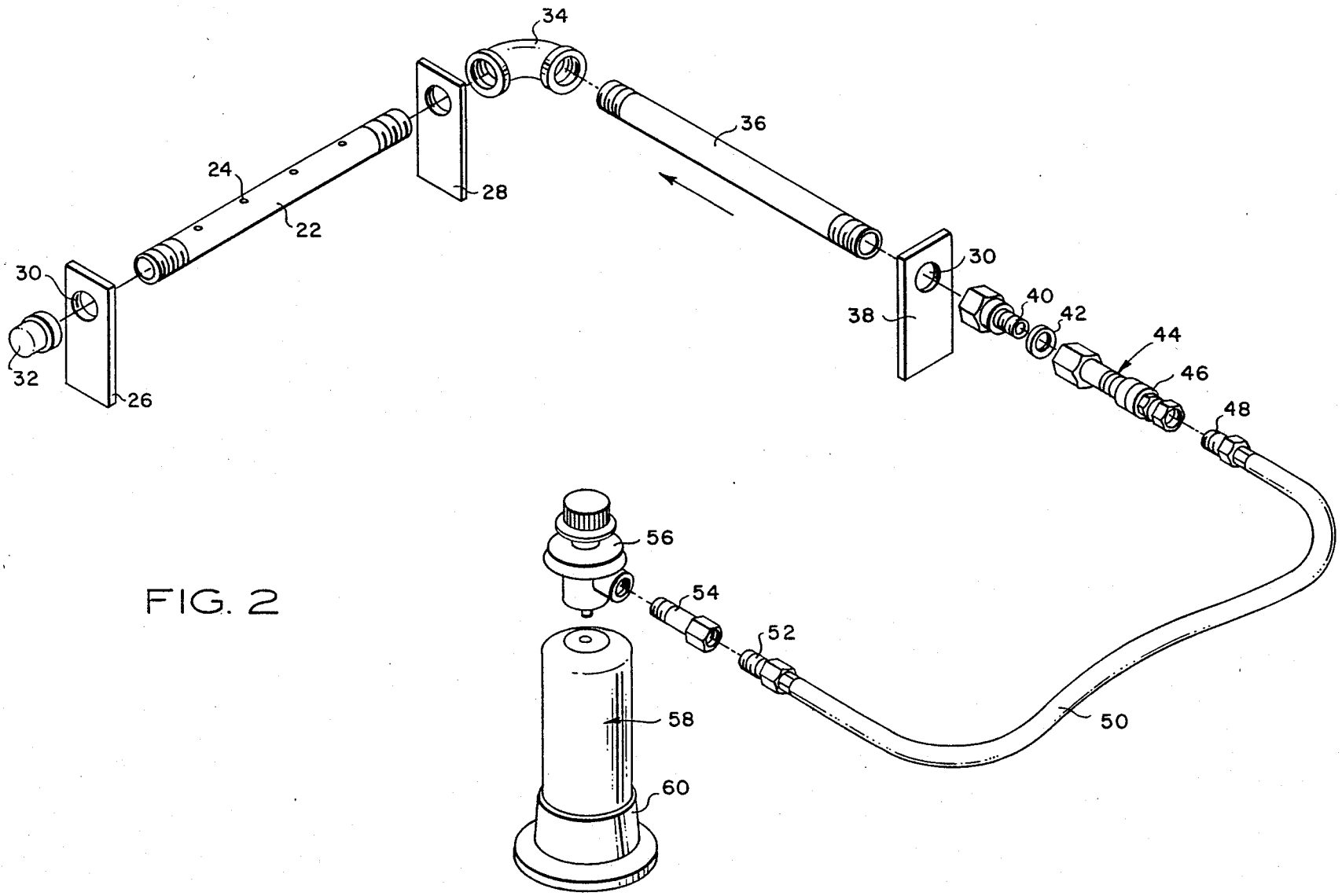
FIG. 2 is an enlarged partially exploded isometric view of the igniter apparatus hereof; and, FIG. 3 is a sectional elevation as seen substantially along the line 3—3 of FIG. 1.

Referring also to FIGS. 2 and 3, the igniter apparatus hereof for igniting a log 18 on grate 14 is generally designated 20. Comprising the igniter apparatus 20 is an internal section for placement within the fireplace in the form of a tubular burner 22 of standard schedule cast iron pipe. A plurality of gas ports 24 are formed in the sidewall of the pipe 22 from which a gaseous fuel can be discharged for burning. A pair of upstanding leg brackets 26, 28 each having an aperture 30 are received over the ends of burner 22 for elevating the burner pipe 22 from the surface of hearth 12.

One end of burner 22 is closed off by a means threaded cap 32. The opposite end is secured to an elbow 34 which in turn is joined to a standard schedule cast iron fuel delivery nipple 36. The fuel delivery nipple 36 is supported generally coplanar with burner 22 by a leg bracket 38. Secured to the nipple end is a reducer 40 on which is supported a washer 42 and a quick connect coupling plug 44. Connector plug 44 is of a type commercially available from suppliers of propane products.

The external nipple section 36E outward of the fireplace includes a quick connect socket 46 adapted to be received in plug 44. Socket 46 is mounted on the fitting 48 of an elongated flexible delivery hose 50 which may, for example, be of a type marketed under the trademark Extend-A-Flow. The fuel delivery hose has a working pressure rating of 350 psi and a burst rating of 1,750 psi. The opposite end of the fuel delivery hose 50 includes a fitting 52 for connection to an orifice plug 54 which is adapted to be secured to the outlet port of a valve regulator assembly 56. The valve regulator may, for example, be of a type suitable for use with bottled propane.

For supplying the pressurized gas fuel to burner 22 there is provided for detachable mounting to the inlet underside of regulating valve 56, a cylinder 58 of pressurized fuel which preferably comprises propane. Cylinders 58, containing a propane charge, are widely available wherever hardware supplies are sold. For supporting cylinder tank 58 there is provided a molded cup base 62 suitable for floor mounting and recessed internally for receipt of the bottom end of tank 58.

In operation, the internal burner 22 of the igniter apparatus 20 is positioned on the hearth 12 of fireplace 10 at a location approximately intermediate the support legs of grate 14. Support plates 26, 28 and 38 set the height of burner 22 at an intermediate level between the hearth 12 and the bars of grate 14 on which a log 18 is to be supported. The external fuel delivery nipple 36E is extended out of the fireplace and is supported by leg 38 on the fireplace platform 62. The flexible delivery hose 50 and fuel cylinder 58 are set up safely away from the fireplace opening.

At such time as a log 18 is to be ignited, connector socket 46 is coupled to quick connector plug 44 so as to place burner 22 in flow communication through hose 50 and regulator valve 56 to cylinder 58. Opening the valve 56 causes gas under pressure in cylinder 58 to be released through the fuel delivery hose and nipple for flow through the outlet ports 24 of burner 22. When gas flow is initiated, a match is utilized to ignite the fuel discharging through ports 24.

After the proper flame height is set by valve 56, fuel burning is permitted to continue at least until after a satisfactory flame burning of log 18 becomes evident. At that point, valve 56 is turned off and the external section is released from the internal section by uncoupling socket 46 from quick connector plug 44. The cylinder 58 and attachments are thereafter stored for future use. When the fuel supply in cylinder 58 is exhausted, the cylinder can be discarded and replaced by a fully charged cylinder.

Because the burner 22, support legs 26, 28 and fuel delivery nipple 36 are made of fire resistant cast iron, they can be left beneath the grate and burning logs, if desired. Optionally, the burner and nipple can be removed as desired for hearth cleaning and storage.

By the above description there is disclosed an improved, portable igniter for igniting logs in a fireplace. The apparatus including the fuel supply is completely portable and can be quickly set up and removed after starting a log fire in a fireplace so as to overcome many of the difficulties previously associated with newspaper bundles and the like. By providing convenient ignition of fireplace logs, fireplace enjoyment is significantly enhanced. As a result, many fireplaces which have previously remained unused for extended periods of time because of the fire building difficulties associated therewith can now be enjoyed more fully at will and without the attendant difficulties. While principally intended for fireplace use, it will be appreciated that the igniter apparatus hereof may also be used elsewhere, such as campgrounds, or wherever log fires are desired.

Since many changes could be made in the above construction and many apparently widely different embodiments of this invention could be made without departing from the scope thereof, it is intended that all matter contained in the drawings and specification shall be interpreted as illustrative and not in a limiting sense

What is claimed is:

1. A portable igniter for ignition of logs to a flame burning state comprising:

a tubular burner having a plurality of spaced apart ports from which a gaseous fuel can be emitted for burning;

fuel delivery means for internally communicating received gaseous fuel under pressure to said burner;

connector means operable to effect a coupled connection to said fuel delivery means;

a controlled source of bottled fuel gas under pressure in communication with said connector means and adapted when said connector means is coupled to said fuel delivery means to supply gaseous fuel for combustion to said burner;

an elongated metal nipple connected to said burner and extending transversely therewith;

first and second support brackets coupled to said burner and nipple, respectively; and, a third support bracket coupled to one of said burner or nipple near the union thereof.

* * * * *